United States Patent [19]

Whipple

[11] Patent Number: 4,718,178

[45] Date of Patent: Jan. 12, 1988

[54] GAS NOZZLE ASSEMBLY

[76] Inventor: Rodger E. Whipple, 922 S. Park Ave., Neenah, Wis. 54956

[21] Appl. No.: 803,128

[22] Filed: Nov. 29, 1985

[51] Int. Cl.[4] ..... F26B 13/02

[52] U.S. Cl. ..... 34/156; 34/160; 226/97; 239/461; 239/463; 239/553.5; 239/568; 239/590; 239/593; 239/DIG. 7

[58] Field of Search ..... 239/590, 590.5, 593, 239/DIG. 7, 461, 463, 553.5, 568; 34/156, 160; 226/97

[56] References Cited

U.S. PATENT DOCUMENTS

| | | | |
|---|---|---|---|
| 2,052,869 | 9/1936 | Coanda | 299/107 |
| 3,448,907 | 6/1969 | Otepka et al. | 34/156 |
| 3,452,447 | 7/1969 | Gardner | 34/156 |
| 3,549,070 | 12/1970 | Frost et al. | 226/97 |
| 3,587,177 | 6/1971 | Overly et al. | 34/156 |
| 3,763,571 | 10/1973 | Vits | 34/57 |
| 3,807,056 | 4/1974 | Norfolk | 34/156 |
| 3,868,215 | 2/1975 | Frezza | 34/160 |
| 3,982,327 | 9/1976 | Kurie et al. | 34/156 |
| 3,982,328 | 9/1976 | Gustaffson et al. | 34/156 |
| 4,058,244 | 11/1977 | Vits | 226/97 |
| 4,074,841 | 2/1978 | Kramer et al. | 226/97 |
| 4,085,522 | 4/1978 | Stroszynski | 34/156 |
| 4,137,644 | 2/1979 | Karlsson | 34/23 |
| 4,218,001 | 8/1980 | Vits | 226/97 |
| 4,247,993 | 2/1981 | Lindström | 34/156 |
| 4,271,602 | 6/1981 | Grolms | 34/160 |
| 4,274,210 | 6/1981 | Stengard | 239/DIG. 7 |
| 4,308,984 | 1/1982 | Vits | 226/97 |
| 4,384,666 | 5/1983 | Koponen et al. | 226/97 |
| 4,414,757 | 11/1983 | Whipple | 34/155 |
| 4,472,888 | 9/1984 | Spiller | 35/156 |
| 4,505,412 | 3/1985 | Reba | 225/96 |
| 4,556,172 | 12/1985 | Sugawara | 239/590.5 |

FOREIGN PATENT DOCUMENTS 1774126 4/1968 Fed. Rep. of Germany .

*Primary Examiner*—Andres Kashnikow
*Assistant Examiner*—Michael J. Forman
*Attorney, Agent, or Firm*—Kinney & Lange

[57] ABSTRACT

A gas nozzle for a dryer apparatus for use with moving webs includes a planar pressure plate with an upstream end portion and a downstream terminus portion and a gas discharge nozzle disposed at the upstream portion of the pressure plate to define a slot for gas flow parallel to the pressure plate. The nozzle includes a first jet forming plate which engages the upstream end portion of the pressure plate and at obtuse angle and which includes a vortex forming step. The nozzle also includes a second jet forming plate located a distance from the first jet forming plate. The two jet forming plates and the step define a passageway for gas flow parallel to the pressure plate.

45 Claims, 27 Drawing Figures

GAS NOZZLE ASSEMBLY

BACKGROUND OF THE INVENTION

1. Field of the Invention

The present invention relates to gas nozzles. In particular, the present invention relates to an improved gas nozzle for use to support a continuous web of moving material such as paper, film, textiles, etc.

2. Description of the Prior Art

Web dryers have been used in the manufacture of paper and the like and in the printing and coating of webs of paper, synthetic materials, films, etc. A gas or vapor, such as steam or air, is supplied from one or more airbars and is used to float a continuous web of material such as paper, film, textiles, cording, steel, etc. By heating or cooling the air relative to the continuous web material, heat can be transferred to or from the material by forced convection, thereby aiding in effective temperature changes, evaporating solvents from the web, curing material added to the web, etc.

Prior attempts to fulfill these objectives have one feature in common: the air jet exiting the airbar is formed by converging or parallel passages which accelerate and smooth the flow. Any discontinuities in the passageway, such as those introduced by structural supports (pins), welds, or hole boundaries (in the case of jets formed by discrete holes instead of continuous slots), leave a wake in the jet stream which causes cross-web variations in air flow heat transfer.

Most of the prior devices have been designed to provide a specific heat transfer pattern. For example, U.S. Pat. No. 3,549,070 to Frost et al. uses two jets of air impinging on the web, causing two peaks of high heat transfer. U.S. Pat. No. 3,587,177 to Overly et al. uses the Coanda effect (discussed in U.S. Pat. No. 2,052,869 to Coanda) to create a flow parallel to the web. This results in a moderate, relatively even heat transfer in the web direction.

Although these prior art methods are adequate for a specific process, a web dryer may be needed for a variety of processes, each of which has specific heat transfer requirements. Even within one process, such as the drying of a clay coating on paper, the early and late stages of the drying cycle may tolerate high heat and mass transfer rates, while an intermediate stage may require extremely even and moderate to low heat and mass transfer rates.

It is desirable from an engineering and manufacturing point of view to have a variety of airbar designs, each of which is made nearly the same, yet each of which can be used to obtain different heat transfer patterns and web handling characteristics. These various characteristics may be required due to the differences in web structural characteristics, such as weight, strength, stiffness, thickness, etc. and in web tension control levels.

SUMMARY OF THE INVENTION

The present invention is a gas nozzle for supporting continuous webs of moving materials such as paper, film, textiles, etc. The gas nozzle of the present invention includes a jet forming means for defining a slot for the flow of gas. A vortex forming means is positioned near the outlet of the jet directing means. The nozzle further includes a plate means which is positioned proximate the vortex forming means. In operation, the gas leaves the jet forming means and a vortex is formed within the vortex forming means. The vortex causes the gas jet to be bent toward the plate means and to flow parallel to the plate means.

The invention further includes embodiments of airbars using the nozzle of the present invention. The airbars include one or more nozzles to direct the flow of gas to support webs of material.

DETAILED DESCRIPTION OF THE PREFERRED EMBODIMENTS

Figure 1:
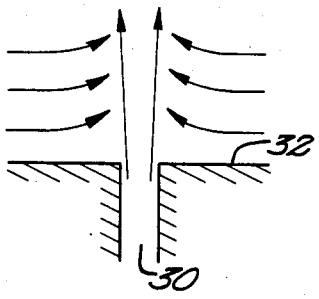
FIGS. 1–9*b* show the behavior of a gas jet in response to surroundings with varying geometric configurations.

In order to completely describe the present invention, a brief introduction to gas flow characteristics is helpful. FIG. 1 shows a line jet of gas, such as air, exiting a slot opening 30 which is located in an infinite plane wall 32. When the jet leaves the slot 30, it entrains air from the surroundings by setting up a negative pressure around the jet which sucks air from the local area toward the jet. This entrainment causes the jet to spread as it gets further from the wall 32.

Figure 2:
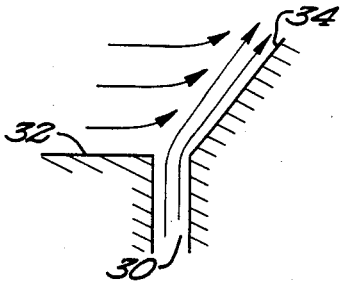

FIG. 2 shows the effect of an infinite side wall 34 on the path of the jet. The infinite side wall 34 prevents the flow of air toward the jet on one side and a counterforce results from this small pressure difference. This force tries to move the jet and the side wall 34 toward each other with the result that the jet is pulled toward the wall 34.

Figure 3A:
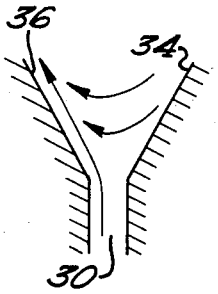
Figure 3B:
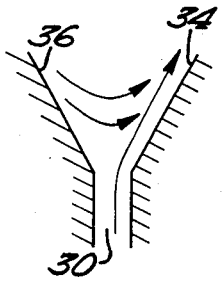

FIGS. 3*a* and 3*b* show the slot opening 30 located between the side wall 34 and a second, similar side wall 36. Under these circumstances, the jet will attach itself to either wall 34 or 36, depending on the geometries of the walls 34 and 36 and any momentary instabilities in the flow. If the jet is physically deflected from one wall 34 to the other wall 36, the jet will tend to remain in the new position. The jet can be physically deflected back to a position along wall 34. This type of a device is called a bi-stable device, and is typical of some fluidic control elements.

Figure 4:
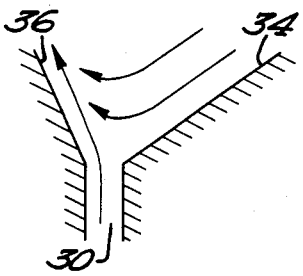

As shown in FIG. 4, the angle between the axis of the slot 30 and each of the walls 34 and 36 does not have to be the same. The jet will have a propensity to stick to the closer wall, even though it will stick to the further wall, if physically deflected. In FIG. 4, the jet will have a tendency to flow along wall 36, due to its closeness to the axis of the slot opening 30.

Figure 5:
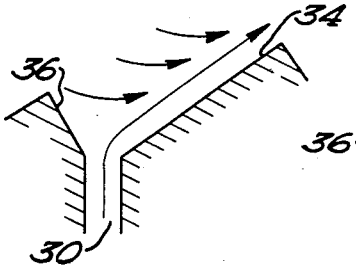

As shown in FIG. 5, making either or both of the walls finite in length also affects the ability of the jet to stick to one wall or the other. This is because the attractive force between a wall and the jet is proportional to the speed of the jet (amount of negative pressure at the jet surface) and the area of the jet exposed to the wall. The attractive force is also inversely proportional to the distance of the wall from the jet. In FIG. 5, the jet will have a tendency to stick to wall 34 due to the length of the wall 34 relative to wall 36.

Figure 6:
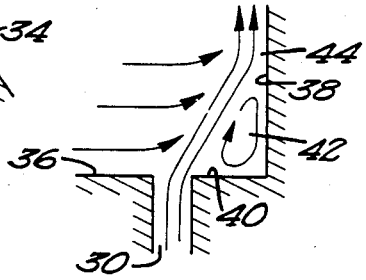

FIG. 6 shows a side wall 38 offset a finite distance from a jet slot 30 by spacer wall 40. The jet is still attracted to the offset wall 38. However, since the jet cannot follow the discontinuity of the spacer wall 40, a vortex 42 is formed in the area between the slot opening 30 and a reattachment point 44 of the jet to the wall 38.

Figure 7:
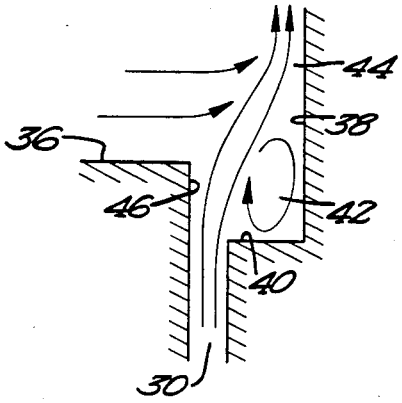

As shown in FIG. 7, if a finite extended wall 46 is placed opposite to offset wall 38, the reattachment point 44 of the jet to the offset wall 38 may be changed. The location of the reattachment point 44 depends on the pressures acting on the jet due to the wall geometries and the jet velocity.

Figure 8:
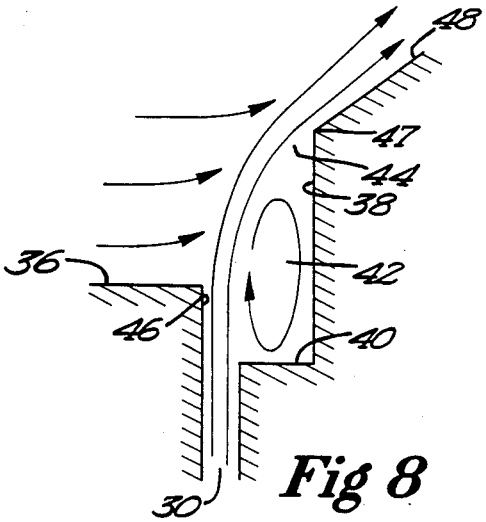

FIG. 8 shows the resultant flow when a bend 47 is placed in the offset wall 38 near the reattachment point 44. This geometry causes the jet to be further deflected to follow the bend 47 along an extended wall 48. The sum of the pressures exerted by the vortex 42 and the extended wall 48 affect the angle of the jet as it approaches the bend 47 along the offset wall 38. Of course, not only do the geometries affect the location of the reattachment point 44, but they also affect the shape and velocity profile of the jet itself.

Figure 9A:
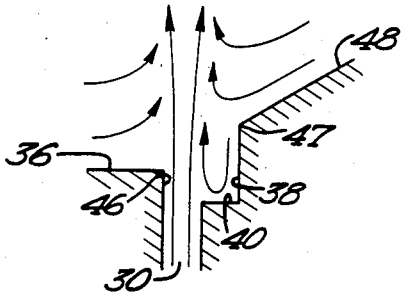
Figure 9B:
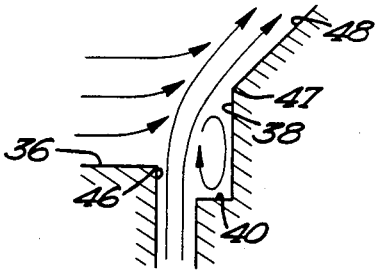

FIGS. 9*a* and 9*b* show the effects of differing geometries on the jet flow. The dimensions of the offset wall 38, the spacer wall 40 and the extended wall 48, the size of the slot opening 30, the dimensions and angle of the bend 47, and the turning angle of the jet all have a considerable effect on whether the jet continues along its initial jet axis or is turned to flow generally parallel to the extended wall 48. FIG. 9*a* generally shows on-axis flow in which the jet is not attracted toward the offset wall 38, while FIG. 9*b* shows parallel flow along the extended wall 48.

It is important to note that, depending on the geometry, the flow can be mono-stable on-axis flow, mono-stable parallel flow, or bi-stable on-axis flow/parallel flow. Bi-stable flow is not useful in web handling situations since the speed and direction of the web travel creates ever changing conditions that can cause sudden changes in web stability and heat transfer due to the flow changing from one bi-stable state to another. Furthermore, mono-stable on-axis flow is not relevant since it is not possible to exert enough force on the jet due to the wall geometries to greatly affect the flow shape and velocity distribution. Consequently, when such a nozzle is used for forced convection heat transfer of the web, few changes, if any, can be made to affect the heat transfer pattern. Instead, it is easier to use a simple converging nozzle.

In order to apply the above relationship to a useful device, the presence of a web 50 must be taken into account. The web 50 will be affected in two ways by the flow of the air. First, the air affects the flotation stability of the web 50 and second, the way in which the air hits or passes along the web 50 affects the heat transfer pattern.

Figure 10:
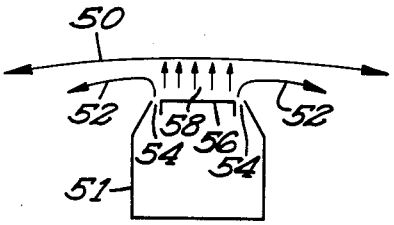
Fig 10 PRIOR ART
FIGS. 10 and 11 show methods of supporting a web in accordance with the prior art.

FIG. 10 shows one way of maintaining the stability of the web 50 which uses a double impingement airbar 51 with two vertically directed air streams 52 flowing from orifices 54 that are separated by a horizontal plate 56. A positive pressure pad 58 is created between the web 50 and the horizontal pressure plate 56. This interacts with the tension of the web 50 to produce a stable configuration.

Figure 11:
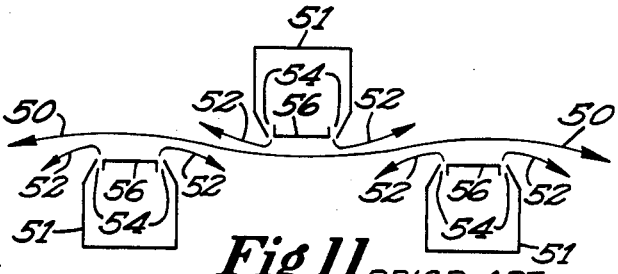
Fig 11 PRIOR ART

FIG. 11 shows several double impingement airbars 51 which are staggered above and below the web 50 and make the web 50 take on a wave shape as it travels along the length of the oven (not shown).

Figure 12A:
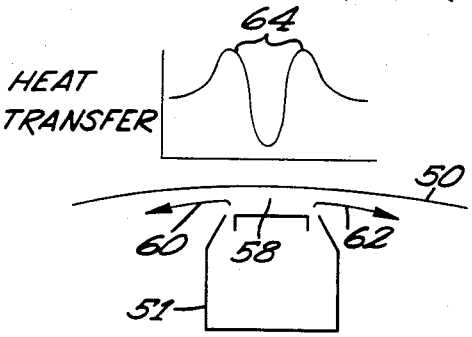
Fig 12a PRIOR ART
FIGS. 12*a* and 12*b* show the heat transfer characteristics of webs.
Figure 12B:
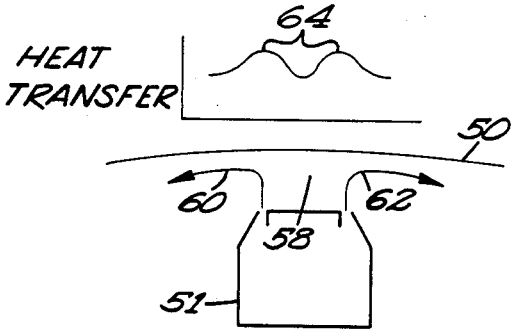
Fig 12b PRIOR ART

FIGS. 12*a* and 12*b* graphically show the heat transfer which occurs in the web using an airbar 51 with two air jets 60 and 62. The heat transfer is intense in the regions where the air jet strikes the web 50, but the effectiveness of heat transfer in the area between the jets is minimal. When the pressure plate 56 and the web 50 are spaced closely together, the heat transfer profile is characterized by severe peaks of high heat transfer 64 and, depending on the tension of the web 50, a noticeable wave form in the web 50 as it travels the length of the oven. As the pressure plate 56 is moved further from the web 50, both the wave amplitude and the heat transfer peaks 64 diminish.

A great deal of the jet's energy is expended when it impinges on the web 50. The majority of the air is forced away from the positive pressure pad 58 between the air jets 60 and 62, and because of the large scale turbulence set up by the air splashing off the web 50, the expended air does not flow completely parallel to the web 50. This means that the velocity of the air that affects the heat transfer falls off rather quickly as the air moves away from the jets 60 and 62. Thus, impingement nozzles in airbars can provide a high peak heat transfer, but in order to provide a high peak heat transfer average, the impingement jets must be located relatively close together.

Figure 13:
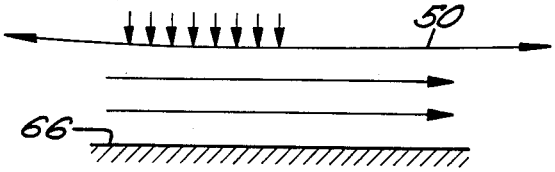
FIGS. 13 and 14 show general patterns of gas flow in web-airbar systems.

An airbar that provides parallel flow instead of impingement flow gives a more uniform heat transfer. As shown in FIG. 13, the stability of the web 50 in a parallel flow arrangement differs from the impingement situation because an air stream flowing between a solid surface 66 and a flexible web 50 under tension will produce a mild vacuum. An equilibrium occurs when the tension of the web 50 supports the negative pressure by means of a slight concave curvature. Because the parallel jet moves the web 50 toward the solid surface 66, the downstream channel widens so that the flow tends to slow down, raising the static pressure and thereby pushing the web 50 away from the surface 66. As long as there is a moderate amount of web tension, this is a stable situation.

Figure 14:
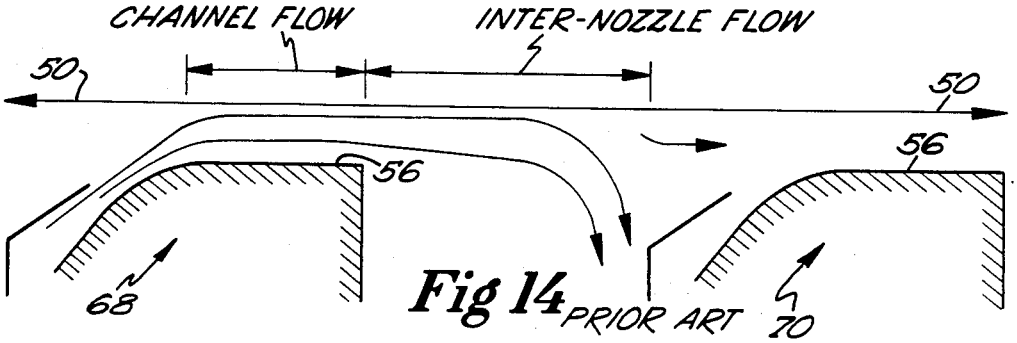
Fig 14 PRIOR ART

In some cases a parallel flow airbar, such as shown in FIG. 14, is used with a web 50 in an oven in such a way that the web 50 is allowed to find its natural web clearance dimension. One such situation is present when airbars 68 and 70 are located on just one side of the web 50. This is commonly called a one-sided oven. The dynamic stability of the web 50 is then an important factor in maintaining the web 50 in its proper relationship to the airbars 68 and 70 in order to get good heat transfer. In situations like these, the airflow must be almost completely parallel to the average line of the web 50 and the airbar pressure plates 56. The web 50 is automatically maintained at the free stream jet boundary since if the web 50 moves away from the jet, the negative pressure due to the jet pulls it back. Conversely, if the web 50 moves into the jet, the jet's momentum pushes it away.

In other situations, the stiffness and/or the tension of the web 50 permit the web 50 to be located at an arbitrary distance from the airbars 68 and 70 without compromising the stability of the web 50. In fact, the web 50 can be located so that it forms a jet containment wall.

The heat transfer created by a parallel flow airbar 68 acting on a web 50 can be divided into two regions: a channel flow region defined by the pressure plate 56 and an inter-nozzle region between the airbars 68 and 70 where the flow leaving the airbar 68 continues to flow next to the web 50. In the channel flow region, the average jet velocity is maintained by the fixed distance that the web 50 is from the pressure plate 56. In the inter-nozzle region, the jet is bounded on one side by the web 50 which acts as a wall and is free to expand on the other side. Consequently, the jet expands and the velocity decreases.

It is well-known that, in general, forced convection heat transfer is proportional to the air velocity and the temperature difference between the air jet and the surface of the web 50. Clearly, control of the local jet velocity and the local air-to-web temperature will result in control over the local heat transfer coefficient.

A further phenomenon must also be taken into account with respect to heat transfer. In cases where flow enters a channel or a pipe, the boundary layer is thin (theoretically zero at the very entrance). This allows more heat to get to the surface, thereby increasing the local heat transfer coefficient, which at the entrance is theoretically infinite. As reported by Boelter, Young, and Iversen and shown in the *Handbook of Heat Transfer* published by McGraw-Hill Book Co., 1973, pages 7-36 through 7-38, the local heat transfer coefficient is affected by the inlet configuration. This phenomena has the effect of substantially raising the local heat transfer coefficient.

With impingement flow and parallel flow there are a number of variables that can be manipulated to control the local heat transfer coefficients and consequently, the overall heat transfer profile. For example, the jet velocity is a gross control over the heat transfer profile. In addition, the jet temperature controls the overall heat transfer profile. The web-to-airbar clearance controls the average jet velocity in the channel flow region for parallel flow. This also has an effect on the amount of energy an impingement flow jet will lose before it hits the web 50.

The nozzle geometry also affects overall heat transfer in parallel flow. The nozzle geometry can affect the entrance condition, thereby affecting the heat transfer due to the entry effect. The nozzle geometry can also affect the amount of cooler air entrained from ahead of the airbar 68, thereby affecting the local air-to-web temperature difference.

The arrangement of the nozzles in forming the airbar 68 also affects the overall heat transfer profile. This arrangement affects all of the above variables and also affects whether the flow is parallel or impingement or a combination thereof. The arrangement of the nozzles can also affect the jet flow in the inter-nozzle region.

Figure 15:
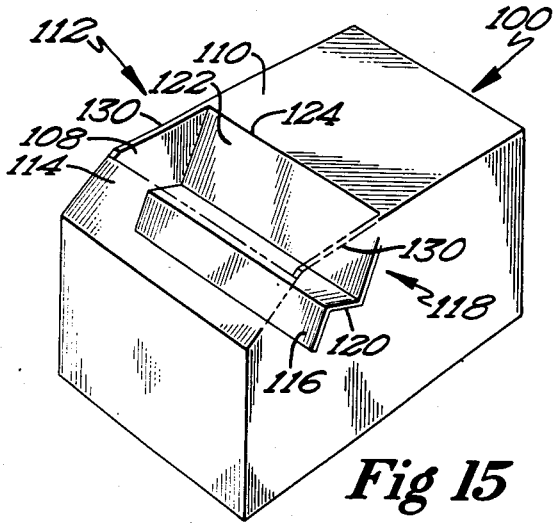
FIG. 15 is a perspective view of an airbar including a nozzle according to the present invention.
Figure 16:
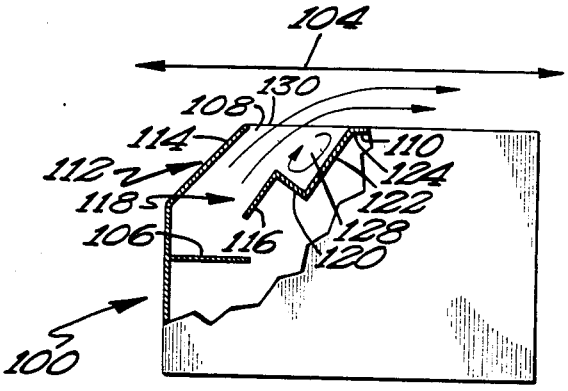
FIGS. 16 and 17 are end views of an airbar including the nozzle in accordance with the present invention.
Figure 17:
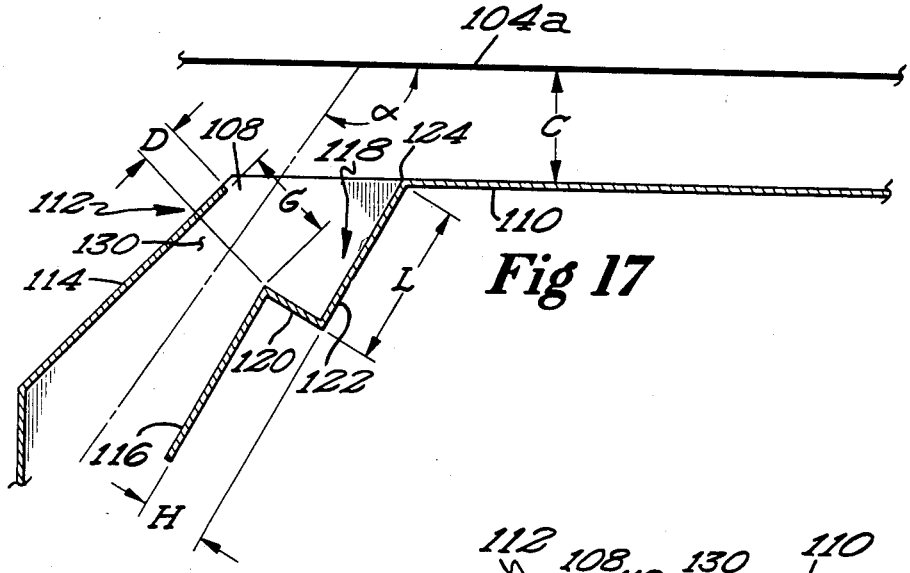

FIGS. 15–17 show an airbar 100 in accordance with the present invention. The airbar 100 is a complete assembly that conveys air, or any other gas, from an air distribution manifold assembly (not shown) to the web 104. The airbar 100 may contain various baffles 106 to guide and distribute the airflow uniformly to an exit orifice 108. The airbar 100 may have one or several exit orifices 108 where an air jet is formed to impart forced convection heat transfer to the web 104. Typically, the airbar 100 includes a pressure plate 110 that is generally parallel to the plane of the web 104.

The airbar 100 includes a nozzle, generally shown at 112. The nozzle 112 is that portion of the airbar 100 that forms and guides the forced convection jet out of the exit orifice 108. One or more nozzles 122 may be used on an airbar 100 to gain the desired heat transfer and web stability.

The nozzle 112 of the present invention is formed by an outer orifice forming plate 114 and an inner orifice forming plate 116. A step 118 is formed adjacent to the inner orifice forming plate 116 by a short side 120 and a long side 122. The pressure plate 110 is connected along one edge to an edge of the long side 122 to form a bend 124. The combination of the inner orifice forming plate 116 and the step 118 constitutes a first jet forming plate and the outer orifice forming plate 114 constitutes a second jet forming plate.

In operation, air or other gas is supplied from the air distribution manifold 102 and flows between the outer and inner orifice forming plates 114 and 116 along jet axis 126. The jet axis 126 is generally described by a plane that bisects the space between the outer orifice forming plate 114 and the inner orifice forming plate 116. When the air jet reaches the step 118, a vortex 128 is formed within the step 118. The jet of air curves around the vortex 128 and the bend 124 and reattaches to the pressure plate 110.

A pair of end plates 130 are supplied on both ends of the nozzle 112 in order to produce the desired flow. Without such end plates 130, air would simply be sucked in from the ends of the nozzle 112 and the vortex 128 would not be formed, particularly on short airbars. On lone airbars, the vortex 128 would dissipate near the edge of the web 104. The end plates 130 are generally connected to the edges of the pressure plate 110 and the outer orifice forming plate 114 as well as the remainder of a perimeter around the airbar 100.

Figure 18:
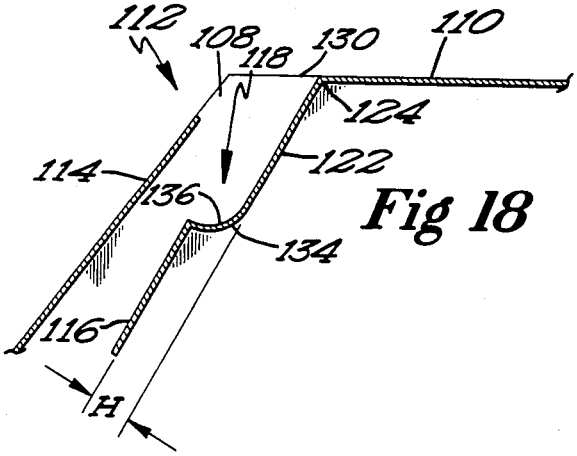
FIG. 18 is an end view of an embodiment in accordance with the present invention.

FIG. 18 shows another embodiment of the nozzle 112 wherein the step 118 is formed along a curve 134 which has a radius 136 equal to the dimension H (which is the height of the short side of the step 120 in FIG. 17). The curve is tangent to the long and short sides 122 and 120 of the step 118. The effect of this type of step arrangement in producing a vortex which steers the air jet is the same as the step arrangement described above.

There are several requirements of nozzle geometry which must be followed for proper operation. The first requirement is that no portion of the exit orifice 108 or the outer orifice forming plate 114 can be closer to the web 104 than the pressure plate 110. In other words, no portion of the nozzle 112 may extend beyond a plane defined by the pressure plate 110.

A second requirement is that the jet turning angle $\alpha$ is generally greater than 90° and less than approximately 150°. The jet turning angle $\alpha$ is the angle formed by the intersection of the jet axis 126 and web line 104A, which is the average position of the web 104 in a plane generally parallel to the pressure plate 110.

A third requirement is that no portion of theo uter orifice forming plate 114 downstream of the orifice 108 can cross the plane defined by the inner orifice forming plate 116. Furthermore, the outer orifice forming plate 114 is located either so that it is parallel to the inner orifice forming plate 116 or so that the air flow converges as the air approaches the exit orifice 108.

The dimensions and angles of the various elements of the nozzle 112 must be such that the air flow is monostable. If not affected by the flow from other nozzles, other airbar elements or other outside elements such as the web 104, the air flow will be generally parallel to the pressure plate 110.

For proper operation of the nozzle 112, the outer orifice forming plate 114 dimension D is greater than zero. The dimension D of the outer orifice forming plate 114 extends downstream from the orifice 108.

Within the limit described with regard to mono-stability, the step aspect ratio (long side 122/short side 120) generally is greater than about 1.0 and less than about 6.0 for mono-stable flow.

Figure 19:
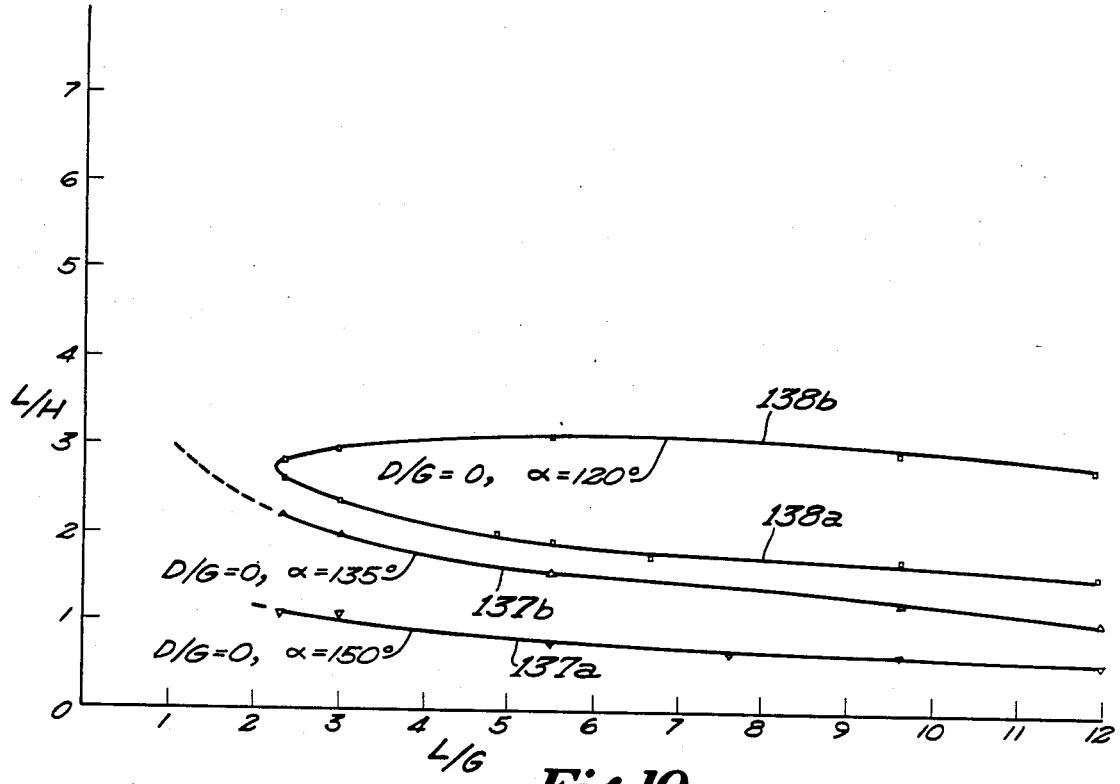
FIGS. 19 and 20 show the regions of mono-stable air flow for a nozzle in accordance with the present invention.

FIG. 19 shows the regions of mono-stable flow for different values of the jet turning angle. Curve 137*a* represents the lower limit of the aspect ratios of L/H (long side of step 122/short side of step 120) for $\alpha=150°$ and D/G=0 which results in mono-stable flow. G represents the width of the orifice 108 between the outer orifice forming plate 114 and the inner orifice forming plate 116. Thus, the area above the curve represents the values of L/H for which the flow will be mono-stable and accordingly, for $\alpha=150°$, the upper limit of aspect ratios of L/H is infinity.

Curve 137*b* represents the lower limits of the aspect ratios of L/H for $\alpha=135°$ and D/G=0, and the area above the curve represents the values of L/H for which the flow will be mono-stable. Once again, the upper limit of the aspect ratio is infinity.

Curve 138*a* represents the lower limits of aspect ratios of L/H for $\alpha=120°$ and D/G=0, and curve 138*b* represents the upper limits of aspect ratios. The area between the curves 138*a* and 138*b* shows the values of L/H which will produce mono-stable flow.

As can be seen from FIG. 19, as the turning angle $\alpha$ is made sharper, the allowable range of values for L/H decreases. The values of lower aspect ratio limits increase rather slowly, while the upper limits rapidly fall from infinity. As the values of $\alpha$ approach 90°, there are fewer values for L/H which will produce mono-stable flow.

Figure 20:
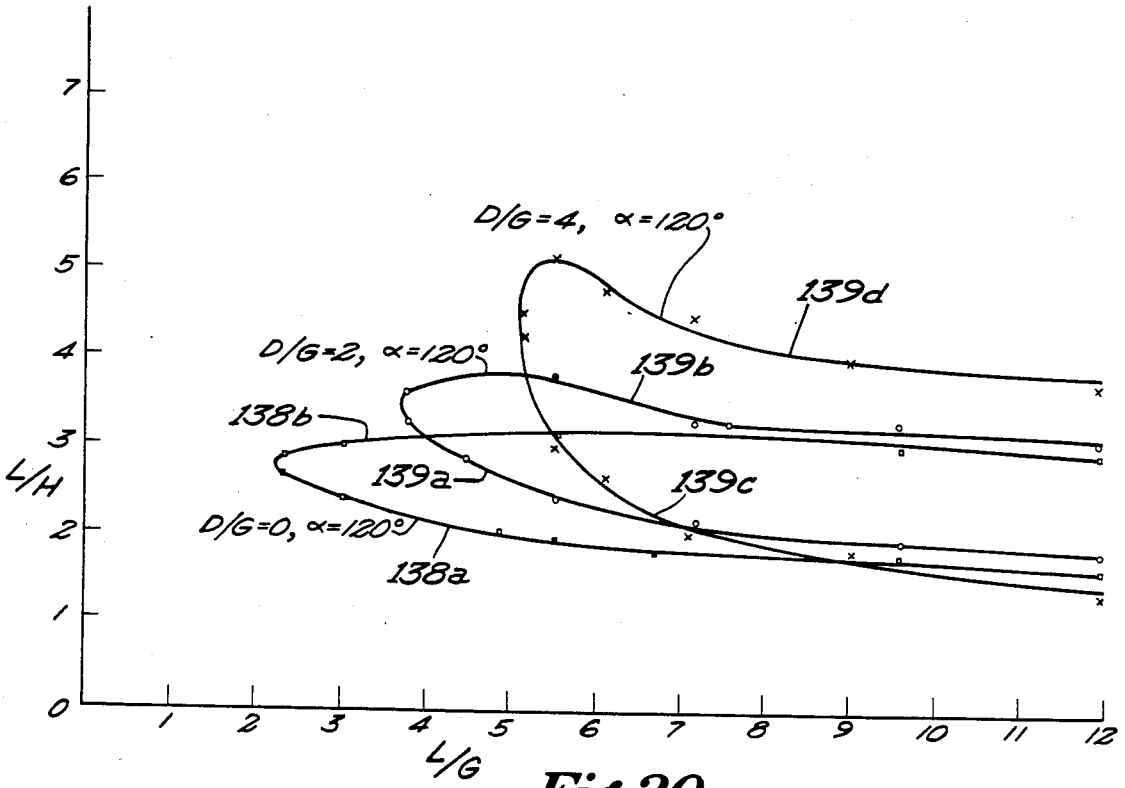

FIG. 20 shows how the areas of mono-stable flow vary as the ratio of D/G is increased while the turning angle $\alpha$ is kept constant. Curve 138*a* and 138*b* define the area of mono-stable flow for D/G=0 and $\alpha=120°$. Curves 139*a* and 139*b* show the area of mono-stable flow for D/G=2, and curves 139*c* and 139*d* show the area of mono-stable flow for D/G=4. As can be seen from these curves, as D/G increases, a mono-stable flow geometry generally requires a higher L/G and L/H.

Thus, the variation of the mono-stable region as the geometry is changed can be summarized generally. First, as the turning angle decreases from 180° to 90°, the mono-stable region gets smaller.

Second, the high limit step aspect ratio (the largest value of L/H that stills allows mono-stable parallel flow) decreases from infinity at a turning angle of 180° to some finite value at a turning angle less than 150°. Note that these aspect ratios have been determined without regard for the geometrical limits outlined above. The low limit step aspect ratio increases from a value less than approximately 0.8 (for all practical ranges of L/G, i.e., L/G greater than 1) to the same value as the high limit aspect ratio. The central limiting value of L/H depends on the nozzle geometry, but is in the range of 3–5.

Third, for any given L/G, increasing the length of the orifice outer forming plate D, increases the high and low step aspect ratios (L/H).

In using the nozzle 112 of the present invention, the gas velocity can be within the normal well known range.

The step and step vortex play several important roles in the nozzle behavior and effect. First, it is well-known that a smoothly converging passage will accelerate and smooth the air flowing through it. This construction, for example, typifies wind tunnels in the area just upstream of the test section. Furthermore, a continuation of one wall of the nozzle, either straight or in such a way that the flow along the wall does not separate from the wall (as described by Coanda), does very little to agitate the flow. It is also very difficult to make noticeable changes in the shape and velocity profile of this attached jet by changing the radius or angle of the nozzle wall extension. Regardless of what is done, the jet sticks tightly to the wall. As described earlier, the presence and size of the step vortex controls location of the jet reattachment point and other factors that affect the shape and velocity profile of the jet. This step vortex is a highly turbulent element that is connected with the jet flow. This agitates the jet flow and increases its level of turbulence.

Some airbars require the use of an internal structural pin to hold the various airbar elements together in the proper spaced relationship. Other airbars use finite orifices (holes) instead of continuous orifices (slots) for forming the jet. These discontinuities create a downstream wake that can contribute to cross-web variations in the heat transfer. Furthermore, many airbars have the air fed to them from one or more central manifolds depending upon the airbar length. In spite of internal baffling to distribute the air evenly along the length of the airbar, the jet exiting the airbar nozzle can still have cross-web velocity components which can affect the web shape stability or position in the oven.

It is well known among workers in fluid mechanics that a vortex is highly efficient in distributing fluid along its axis. This can be seen by observing flow in a natural tornado or industrial cyclone. The step vortex, located between the jet orifice and the web is placed to help distribute the flow, thereby tending to even out the heat transfer and straighten out the flow.

Consistent with the nozzle 112 described above, four general airbar types can be created. For all of these types, the air can either flow in the same direction as movement of the web 140 or in a direction opposite to the web 140 movement.

A variety of airbars are usually needed in order to handle numerous types of web materials and to create desired types of flotation abilities. Web materials vary greatly in weight, strength, etc. and may require differing heat transfer characteristics. In addition, if a coating is present on the web, it is desireable to arrange heat transfer and flotation to that most suitable to the coating material. The present airbar types present a generalized tool that can be used in a variety of ways for a variety of applications.

Figure 21:
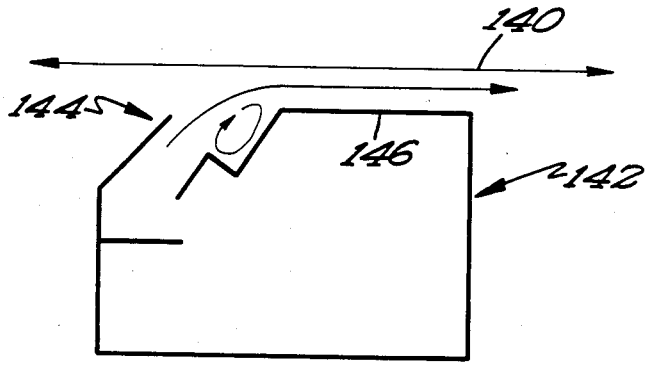
FIGS. 21–24 are end views of embodiments of airbars in accordance with the present invention.

FIG. 21 shows a first embodiment of the present invention which consists of an airbar 142 with a single step nozzle 144 of the type described above. The airbar 142 can be used to support the web from just one side, as when the web 140 is a lightweight material such as paper. The air flows out of the airbar 142 through the step nozzle 144. The air jet flows between the web 140 and a pressure plate 146 to support the web 140.

Figure 22:
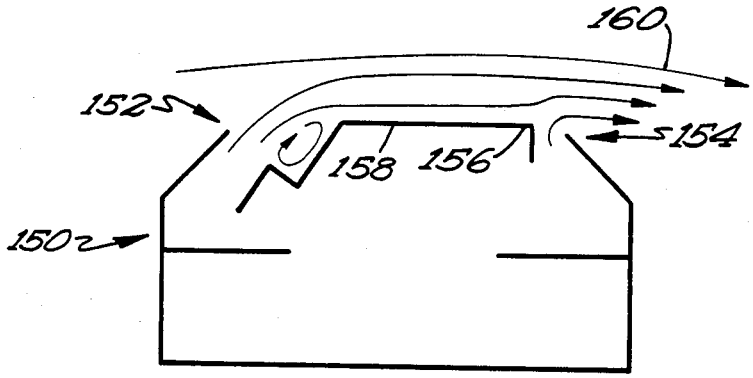

FIG. 22 shows a second embodiment in accordance with the present invention. An airbar 150 is provided with a single step nozzle 152 of the type described above and a single simple nozzle 154. The simple nozzle 154 is located at a downstream end 156 of the pressure plate 158. It is used to accelerate the flow entering the inter-nozzle flow region, thereby raising the heat transfer in this region. The simple nozzle 154 is also used to create a back pressure in the channel flow region, which causes the web 160 to be forced away from the airbar 150. This is useful in absorbing small amounts of slack in the web 160 in lightweight webs due to the cross-web tension variations.

Of course, a second step nozzle (not shown), flowing in the same direction as the first step nozzle could be used instead of a simple nozzle. However, there is no benefit to the use of the second step nozzle in that the object of the second nozzle is to compress the jet emerging from the channel flow region and this second nozzle, in itself, provides little heat transfer. Therefore, the advantage of the step in the nozzle to even out any irregularities in heat transfer is largely wasted.

Figure 23:
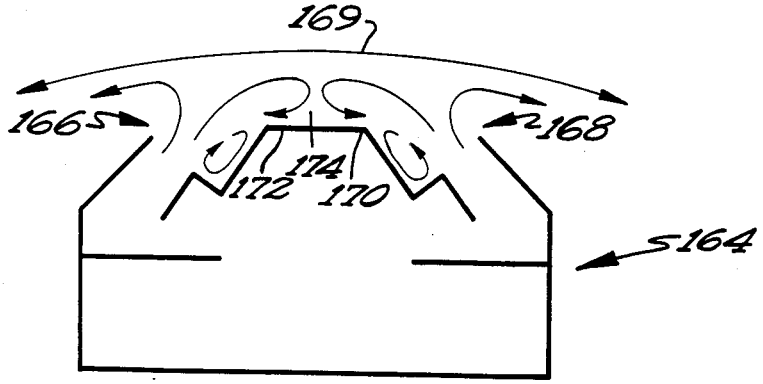

FIG. 23 shows a third embodiment of the present invention. The airbar 164 is provided with a first step nozzle 166 and a second step 168, both as described above. The second step nozzle 168 is located at a downstream end 170 of pressure plate 172. The nozzles 166 and 168 are arranged so that the flow from each nozzle 166 or 168 flows toward the other to support the web 169. The geometry of each nozzle 166 or 168 may or may not be the same, depending on the effect desired. Where the geometries are quite similar, the effect of the airbar arrangement will be to create two impingement jets, separated by a pressure pad 174. Where the geometries of the nozzles 166 and 168 are different enough for one to dominate, the flow pattern will be similar to the second embodiment of the invention described above.

Figure 24:
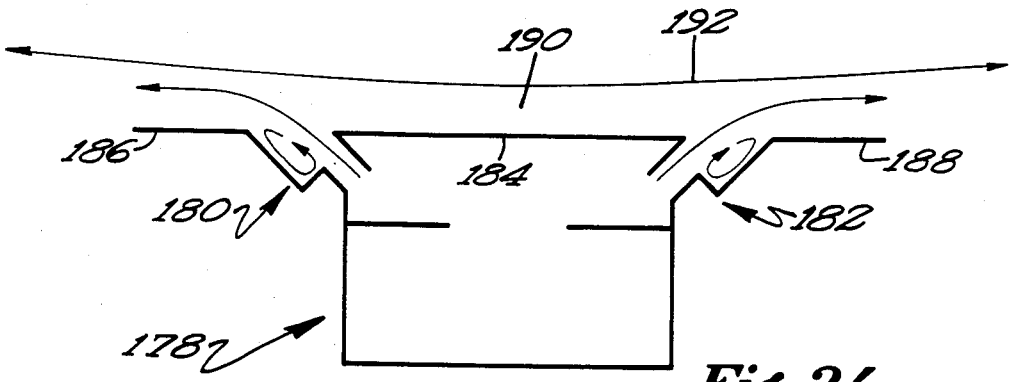

FIG. 24 shows a fourth embodiment of the present invention. This embodiment consists of an airbar 178 with first and second step nozzles 180 and 182. The nozzles 180 and 182 are located such that their respective jets flow away from each other. An intermediate pressure plate 184 is located between the first and second nozzles 180 and 182 and is in a plane with the pressure plate 186 of nozzle 180 and the pressure plate 188 of nozzle 182. An area of low pressure 190 is created between the jets and the web 192. Once again, the geometry of each nozzle 180 and 182 may or may not be the same as the other. This configuration may also be used to support a lightweight web from just one side.

Although the present invention has been described with reference to preferred embodiments, workers skilled in the art will recognize that changes may be made in form and detail without departing from the spirit and scope of the invention.

What is claimed is:

1. A gas nozzle assembly for a dryer apparatus for use with moving webs, comprising:

a planar pressure plate with an upstream end portion and a downstream terminus portion; and a gas discharge nozzle disposed at the upstream end portion of the pressure plate and including first and second end walls connected to the pressure plate and first and second jet forming plates connected between the first and second end walls, wherein:

the first jet forming plate engages the upstream end portion of the pressure plate at an obtuse angle, and wherein the first jet forming plate includes a step positioned adjacent to pressure plate; and the second jet forming plate is spaced from the first jet forming plate, wherein the end walls, the jet forming plates and the step define a passageway therebetween for gas flow and wherein the step enlarges the passageway for gas flow out of the nozzle to produce a vortex which causes gas from the nozzle to flow generally parallel to the pressure plate.

2. The gas nozzle assembly of claim 1 wherein the first jet forming plate further comprises a generally planar portion connected to the step and the step comprises:

a first side connected to the pressure plate; and a second side connected between the first side and the generally planar portion of the first jet forming plate.

3. The gas nozzle assembly of claim 2 wherein the first side and the second side form a generally right angle.

4. The gas nozzle of claim 2 wherein the first side is generally perpendicular to the second side and the sides are joined together along a curved corner.

5. The gas nozzle assembly of claim 2 wherein the ratio of length of the first side of the step to length of the second side of the step is greater than about 0.8.

6. The gas nozzle assembly of claim 2 wherein the ratio of length of the first side of the step to length of the second side of the step is less than about 6.0.

7. The gas nozzle assembly of claim 2 wherein the first and second jet forming plates are positioned with respect to the pressure plate to define a turning angle which is greater than about 90°.

8. The gas nozzle assembly of claim 2 wherein the first and second jet forming plates are positioned with respect to the pressure plate to define a turning angle which is greater than about 150°.

9. The gas nozzle assembly of claim 2 wherein the ratio of length of the first side of the step to distance between the first and second jet forming plates is greater than about 1.0.

10. The gas nozzle assembly of claim 2 wherein the ratio of length of the first side of the step to a minimum distance between the first and second jet forming plates is less than about 12.0.

11. The gas nozzle assembly of claim 2 wherein the ratio of a length of the second jet forming plate extending past the first jet forming plate to a minimum distance between the first and second jet forming plates is generally greater than zero.

12. The gas nozzle assembly of claim 1, wherein the second jet forming plate is generally parallel to a portion of the first jet forming plate.

13. The gas nozzle assembly of claim 1, wherein the second jet forming plate is spaced from the first jet forming plate at a distance which varies such that the passageway converges as the gas flow approaches the step.

14. An airbar for a jet dryer for supporting a moving material web comprising:

a first planar pressure plate generally parallel to the web with an upstream end portion and a downstream terminus portion; and a first nozzle disposed at the upstream end portion of the first pressure plate, the first nozzle comprising: first and second end walls;

a first step having a first side connected to a second side to form a generally right angle, wherein the first side engages the upstream end of the first pressure plate at an obtuse angle;

a first jet forming plate connected between the first and second end walls engaging the second side of the first step wherein the first jet forming plate extends away from and is generally parallel to the first side of the first step; and a second jet forming plate connected between the first and second end walls and located at a distance from the first jet forming plate wherein the first and second jet forming plates, the first and second end walls, and the first step define a first slot for gas flow and wherein the first step is positioned to enlarge the slot for gas flow out of the first nozzle.

15. The airbar of claim 12 and further comprising:

second nozzle spaced from the first nozzle.

16. The airbar of claim 15 wherein the second nozzle is disposed at the downstream terminus portion of the first pressure plate.

17. The airbar of claim 15 wherein the second nozzle is a simple nozzle.

18. The airbar of claim 14 further comprising:

a second planar pressure plate generally parallel to the web with an upstream end portion and a downstream terminus portion; and second nozzle spaced from the first nozzle.

19. The airbar of claim 18 wherein the second nozzle comprises:

a step having a first side connected to a second side to form a generally right angle, wherein the first side engages the upstream end of the second pressure plate at an obtuse angle;

a first jet forming plate engaging the first side of the second step wherein the first jet forming plate extends away from and is generally parallel to the first side of the second step; and a second jet forming plate located at a known distance from the first jet forming plate wherein the first and second jet forming plates and the second step define a second slot for gas flow.

20. The airbar of claim 19 wherein the downstream terminus portions of the first and second pressure plates are joined together to form a continuous pressure plate.

21. The airbar of claim 19 further comprising:

an intermediate pressure plate disposed between and generally parallel to the first and second pressure plates, wherein one edge of the intermediate pressure plate is connected to the second jet forming plate of the first nozzle means and an opposite edge of the intermediate pressure plate is connected to the second jet forming plate of the second nozzle.

22. A gas nozzle assembly for a dryer apparatus for use with moving webs comprising:

a plate;

jet forming means with an outlet and defining an area for the flow of gas along a jet axis which forms an obtuse angle to a plane defined by the plate; and vortex forming means positioned proximate the outlet of the jet forming means and proximate the plate, wherein the vortex forming means is positioned to enlarge the area for the flow of gas out of the jet forming means to produce a vortex which causes the gas from the jet forming means to flow generally parallel to the plate.

23. The gas nozzle assembly of claim 22 wherein the jet forming means comprises:

a first jet forming plate;

a second jet forming plate spaced from the first jet forming plate to define the outlet therebetween, wherein the vortex forming means is located proximate the second jet forming plate.

24. The gas nozzle assembly of claim 23 wherein the first jet forming plate is generally parallel to the second jet forming plate.

25. The gas nozzle assembly of claim 23 wherein spacing between the second jet forming plate and the first jet forming plate varies in a direction defined by the jet axis so that the area of gas flow converges as the gas approaches the outlet.

26. The gas nozzle assembly of claim 22 wherein the outlet is a slot.

27. The gas nozzle assembly of claim 22 wherein the vortex forming means is a step.

28. The gas nozzle assembly of claim 22 wherein the vortex forming means comprises:

a first side connected to the plate;

a second side connected between the jet forming means and the first side.

29. The gas nozzle assembly of claim 28 wherein the first side is generally perpendicular to the second side.

30. The gas nozzle assembly of claim 28 wherein the first side is generally perpendicular to the second side and the sides are joined together by a curved portion.

31. The gas nozzle assembly of claim 28 wherein the first side is generally perpendicular to the second side, and the sides are connected together along a curve with a radius equal to the length of the second side.

32. The gas nozzle assembly of claim 28 wherein the ratio of length of the first side of the step to length of the second side is greater than about 1.0.

33. The gas nozzle assembly of claim 28 wherein the ratio of length of the first side of the step to length of the second side is less than about 6.0.

34. The gas nozzle assembly of claim 28 wherein the obtuse angle is greater than about 90°.

35. The gas nozzle assembly of claim 28 wherein the obtuse angle is less than about 150°.

36. The gas nozzle assembly of claim 28 wherein the ratio of length of the first side of the step to a minimum distance between the first and second jet forming plates is greater than about 1.0.

37. The gas nozzle assembly of claim 28 wherein the ratio of length of the first side of the step to a minimum the distance between the first and second jet forming plates is less than about 12.0.

38. The gas nozzle assembly of claim 28 wherein the ratio of a length of the second jet forming plate extending past the first jet forming plate to a minimum distance between the first and second jet forming plates is generally greater than zero.

39. An airbar for a jet dryer for supporting a material web, comprising:

a first plate;

manifold means for distributing gas;

first orifice means connected to the manifold means and a first edge of the first plate for defining an area of gas flow; and first vortex forming means positioned proximate the first orifice means and the first plate wherein the first vortex forming means is positioned to enlarge the area of gas flow out of the first orifice means to produce a vortex which causes the gas from the first orifice means to flow generally parallel to the first plate.

40. The airbar of claim 30 and further comprising a second orifice means spaced from the first orifice means.

41. The airbar of claim 40 and further comprising:

second vortex forming means positioned proximate the second orifice means and the first plate for producing a vortex which causes the gas from the second orifice means to flow generally parallel to the first plate.

42. The airbar of claim 41 wherein the first orifice means and the second orifice means are disposed at an opposite edge of the first plate.

43. The airbar of claim 41 wherein the flow of gas from the first orifice means is toward the flow of gas from the second orifice means.

44. The airbar of claim 40 and further comprising:

a second pressure plate;

second vortex forming means positioned proximate the second orifice means and the second pressure plate for producing a vortex which causes the gas from the second orifice means to flow generally parallel to the second plate.

45. The airbar of claim 44 and further comprising:

an intermediate pressure plate disposed between and generally parallel to the first and second pressure plates, wherein the intermediate pressure plate is connected along one edge to the first orifice means and along an opposite edge to the second orifice means and wherein the flow of gas from the first orifice means is in a direction opposite the flow of gas from the second orifice means.

* * * * *

UNITED STATES PATENT AND TRADEMARK OFFICE

CERTIFICATE OF CORRECTION

PATENT NO. : 4,718,178

DATED : January 12, 1988

INVENTOR(S) : Rodger E. Whipple

It is certified that error appears in the above-identified patent and that said Letters Patent is hereby corrected as shown below:

Column 11, line 16, after "claim", delete "12" and insert --14--.

Column 13, line 1, after "claim", delete "30" and insert --39--.

Signed and Sealed this

Twenty-fourth Day of May, 1988

*Attest:*

*Attesting Officer*

DONALD J. QUIGG

*Commissioner of Patents and Trademarks*